US010982908B2

(12) United States Patent
Birmingham et al.

(10) Patent No.: US 10,982,908 B2
(45) Date of Patent: Apr. 20, 2021

(54) HEAT TRANSFER SHEET FOR ROTARY REGENERATIVE HEAT EXCHANGER

(71) Applicant: Arvos Ljungstrom LLC, Wellsville, NY (US)

(72) Inventors: James W. Birmingham, Wellsville, NY (US); Glenn D. Mattison, Wellsville, NY (US); Kevin J. O'Boyle, Alma, NY (US); James D. Seebald, Wellsville, NY (US)

(73) Assignee: ARVOS LJUNGSTROM LLC, Wellsville, NY (US)

( * ) Notice: Subject to any disclaimer, the term of this patent is extended or adjusted under 35 U.S.C. 154(b) by 0 days.

(21) Appl. No.: 16/251,915

(22) Filed: Jan. 18, 2019

(65) Prior Publication Data

US 2019/0154354 A1 May 23, 2019

Related U.S. Application Data

(63) Continuation of application No. 14/926,920, filed on Oct. 29, 2015, now Pat. No. 10,197,337, which is a (Continued)

(51) Int. Cl.

| | |
|---|---|
| ***F28D 19/04*** | (2006.01) |
| ***F28D 19/00*** | (2006.01) |
| ***F28F 3/02*** | (2006.01) |

(52) U.S. Cl.

CPC ..... *F28D 19/044* (2013.01); *F28D 19/00* (2013.01); *F28F 3/025* (2013.01)

(58) Field of Classification Search

CPC ..... F28D 19/044; F28D 19/00; F28F 3/025
See application file for complete search history.

(56) References Cited

U.S. PATENT DOCUMENTS

| | | | |
|---|---|---|---|
| 682,607 | A | 9/1901 | Eck |
| 1,429,149 | A | 9/1922 | Lawrence |

(Continued)

FOREIGN PATENT DOCUMENTS

| | | | |
|---|---|---|---|
| CA | 1061653 | A | 9/1979 |
| CA | 2759895 | C | 4/2014 |

(Continued)

OTHER PUBLICATIONS

English translation of Notifications of Reasons for Refusal for Japanese Patent Application No. 2012-509814, dated Feb. 24, 2014.

(Continued)

*Primary Examiner* — Devon Russell
(74) *Attorney, Agent, or Firm* — Murtha Cullina LLP

(57) ABSTRACT

A stack of heat transfer sheets includes one or more first sheet which includes a first undulating surface formed by first lobes that are parallel to each other and oriented at a first angle. The first sheets include a second undulating surface formed by second lobes that are parallel to each other and oriented at a second angle, different from the first angle. The first sheets include a third undulating surface formed by third lobes extending from one or more ends of the first sheet and terminating at an intermediate point between the end and an opposing end thereof. The third lobes are parallel to each other and parallel to the direction of flow through the stack. The stack includes one or more second sheets defining a plurality of sheet spacing features which engage a portion of the first sheet.

6 Claims, 12 Drawing Sheets

Related U.S. Application Data continuation of application No. 12/437,914, filed on May 8, 2009, now Pat. No. 9,557,119.

(56) References Cited

U.S. PATENT DOCUMENTS

| | | | |
|---|---|---|---|
| 1,450,351 | A | 4/1923 | Beran |
| 1,875,188 | A | 4/1923 | Beran |
| 1,477,209 | A | 12/1923 | Cowan |
| 1,524,280 | A | 1/1925 | Bancel |
| 1,894,956 | A | 1/1933 | Kerr |
| 1,915,742 | A | 6/1933 | Mautsch |
| 1,987,798 | A | 1/1935 | Ruppricht |
| 2,023,965 | A | 12/1935 | Lysholm |
| 2,042,017 | A | 5/1936 | Orchard |
| 2,102,936 | A | 12/1937 | Bailey |
| 2,160,677 | A | 5/1939 | Romanoff |
| 2,313,081 | A | 3/1943 | Ljungstrom |
| 2,432,198 | A | 12/1947 | Karlsson et al. |
| 2,438,851 | A | 3/1948 | Gates |
| 2,596,642 | A | 5/1952 | Boestad |
| 2,782,009 | A | 2/1957 | Rippingille |
| 2,796,157 | A | 6/1957 | Ginsburg |
| 2,940,736 | A | 6/1960 | Odman |
| 2,983,486 | A | 5/1961 | Rosenberg |
| 3,019,160 | A | 1/1962 | Slezak et al. |
| 3,111,982 | A | 11/1963 | Ulbricht |
| 3,158,527 | A | 11/1964 | Faccin et al. |
| 3,183,963 | A | 5/1965 | Mondt |
| 3,216,494 | A | 11/1965 | Goodman |
| 3,240,266 | A | 3/1966 | Corbet et al. |
| 3,260,511 | A | 7/1966 | Greer |
| 3,262,490 | A | 7/1966 | Olson |
| 3,317,222 | A | 5/1967 | Maretzo |
| 3,372,743 | A | 3/1968 | Pall et al. |
| 3,373,798 | A | 3/1968 | Brummett |
| 3,415,502 | A | 12/1968 | Munters |
| 3,452,814 | A | 7/1969 | Malewicz |
| 3,490,523 | A | 1/1970 | Esmond |
| 3,523,058 | A | 8/1970 | Shick |
| 3,532,157 | A | 10/1970 | Hubble |
| 3,540,529 | A | 11/1970 | Umino et al. |
| 3,542,635 | A | 11/1970 | Parker |
| 3,574,103 | A | 4/1971 | Latkin |
| 3,674,620 | A | 7/1972 | McCarthy et al. |
| 3,726,408 | A | 4/1973 | Gewiss |
| 3,759,323 | A | 9/1973 | Dawson et al. |
| 3,825,412 | A | 7/1974 | Mullender |
| 3,830,684 | A | 8/1974 | Hamon |
| 3,887,664 | A | 6/1975 | Regehr |
| RE28,534 | E | 8/1975 | Arne |
| 3,901,309 | A | 8/1975 | Thebert |
| 3,940,966 | A | 3/1976 | Deane |
| 3,941,185 | A | 3/1976 | Henning |
| 3,952,077 | A | 4/1976 | Wigley |
| 3,963,810 | A | 6/1976 | Holmberg et al. |
| 4,034,135 | A | 7/1977 | Passmore |
| 4,049,855 | A | 9/1977 | Cogan |
| 4,061,183 | A | 12/1977 | Davis |
| 4,098,722 | A | 7/1978 | Cairns et al. |
| 4,125,149 | A | 11/1978 | Kritzler et al. |
| 4,144,369 | A | 3/1979 | Wass |
| 4,182,402 | A | 1/1980 | Adrian |
| 4,202,449 | A | 5/1980 | Bendt |
| 4,228,847 | A | 10/1980 | Lindahl |
| 4,296,050 | A | 10/1981 | Meier |
| 4,320,073 | A | 3/1982 | Bugler |
| 4,337,287 | A | 6/1982 | Falkenberg |
| 4,343,355 | A | 8/1982 | Goloff et al. |
| 4,344,899 | A | 8/1982 | Monjoie |
| 4,361,426 | A | 11/1982 | Carter et al. |
| 4,363,222 | A | 12/1982 | Cain |
| 4,374,542 | A | 2/1983 | Bradley |
| 4,396,058 | A | 8/1983 | Kurschner et al. |
| 4,409,274 | A | 10/1983 | Chaplin et al. |
| 4,423,772 | A | 1/1984 | Dahlgren |
| 4,449,573 | A | 5/1984 | Pettersson et al. |
| 4,472,473 | A | 9/1984 | Davis et al. |
| 4,501,318 | A | 2/1985 | Hebrank |
| 4,512,389 | A | 4/1985 | Goetschius |
| 4,518,544 | A | 5/1985 | Carter et al. |
| 4,553,458 | A | 11/1985 | Schoonover |
| 4,605,996 | A | 8/1986 | Payne |
| 4,633,936 | A | 1/1987 | Nilsson |
| 4,668,443 | A | 5/1987 | Rye |
| 4,676,934 | A | 6/1987 | Seah |
| 4,689,261 | A | 8/1987 | Ahnstrom |
| 4,744,410 | A | 5/1988 | Groves |
| 4,750,553 | A | 6/1988 | Pohl et al. |
| 4,769,968 | A | 9/1988 | Davis et al. |
| 4,791,773 | A | 12/1988 | Taylor |
| 4,842,920 | A | 6/1989 | Banai et al. |
| 4,847,019 | A | 7/1989 | McNab |
| 4,857,370 | A | 8/1989 | Overbergh et al. |
| 4,858,684 | A | 8/1989 | Brucher et al. |
| 4,862,666 | A | 9/1989 | Kero |
| 4,876,134 | A | 10/1989 | Saitoh et al. |
| 4,906,510 | A | 3/1990 | Todor, Jr. et al. |
| 4,915,165 | A | 4/1990 | Dahlgren et al. |
| 4,930,569 | A | 6/1990 | Harder |
| 4,950,430 | A | 8/1990 | Chen et al. |
| 4,953,629 | A | 9/1990 | Karlsson et al. |
| 4,974,656 | A | 12/1990 | Judkins |
| 4,981,732 | A | 1/1991 | Hoberman |
| 5,085,268 | A | 3/1992 | Nilsson |
| 5,101,892 | A | 4/1992 | Takeuchi et al. |
| 5,150,596 | A | 9/1992 | Hunt et al. |
| 5,308,677 | A | 5/1994 | Renna |
| 5,314,006 | A | 5/1994 | Kaastra et al. |
| 5,314,738 | A | 5/1994 | Ichikawa |
| 5,318,102 | A | 6/1994 | Spokoyny et al. |
| 5,333,482 | A | 8/1994 | Dunlap et al. |
| 5,380,579 | A | 1/1995 | Bianchi |
| 5,413,741 | A | 5/1995 | Buchholz et al. |
| 5,413,872 | A | 5/1995 | Faigle |
| 5,441,793 | A | 8/1995 | Siiess |
| 5,489,463 | A | 2/1996 | Paulson |
| 5,544,703 | A | 8/1996 | Joel et al. |
| H1621 | H | 12/1996 | Ray |
| 5,598,930 | A | 2/1997 | Leone et al. |
| 5,600,928 | A | 2/1997 | Hess et al. |
| 5,605,655 | A | 2/1997 | Ishihara et al. |
| 5,609,942 | A | 3/1997 | Ray |
| 5,647,741 | A | 7/1997 | Bunya et al. |
| 5,667,875 | A | 9/1997 | Usui |
| 5,747,140 | A | 5/1998 | Heerklotz |
| 5,792,539 | A | 8/1998 | Hunter |
| 5,803,158 | A | 9/1998 | Harder et al. |
| 5,836,379 | A | 11/1998 | Counterman |
| 5,899,261 | A | 5/1999 | Brzytwa et al. |
| 5,979,050 | A | 11/1999 | Counterman et al. |
| 5,983,985 | A | 11/1999 | Counterman et al. |
| 6,019,160 | A | 2/2000 | Chen |
| 6,145,582 | A | 11/2000 | Bolle et al. |
| 6,212,907 | B1 | 4/2001 | Billingham et al. |
| 6,251,499 | B1 | 6/2001 | Lehman et al. |
| 6,280,824 | B1 | 8/2001 | Insley et al. |
| 6,280,856 | B1 | 8/2001 | Anderson et al. |
| 6,478,290 | B1 | 11/2002 | Ender et al. |
| 6,497,130 | B2 | 12/2002 | Nilsson |
| 6,516,871 | B1 | 2/2003 | Brown et al. |
| 6,544,628 | B1 | 4/2003 | Aull et al. |
| 6,660,402 | B2 | 12/2003 | Tanabe |
| 6,730,008 | B1 | 5/2004 | Liang |
| 6,764,532 | B1 | 7/2004 | Cheng |
| 7,044,206 | B2 | 5/2006 | Sabin et al. |
| 7,117,928 | B2 | 10/2006 | Chen |
| 7,347,351 | B2 | 5/2008 | Slattery |
| 7,555,891 | B2 | 7/2009 | Muller et al. |
| 7,654,067 | B2 | 2/2010 | Wattron |
| 7,938,627 | B2 | 5/2011 | Muller |
| 8,296,946 | B2 | 10/2012 | Wieres et al. |
| 8,323,778 | B2 | 12/2012 | Webb et al. |
| 9,200,853 | B2 | 12/2015 | O'Boyle et al. |
| 2002/0043362 | A1 | 4/2002 | Wilson |

(56) References Cited

U.S. PATENT DOCUMENTS

| | | | |
|---|---|---|---|
| 2003/0024697 | A1 | 2/2003 | Matsuzaki |
| 2003/0178173 | A1 | 9/2003 | Harting et al. |
| 2005/0274012 | A1 | 12/2005 | Hodgson et al. |
| 2007/0017664 | A1 | 1/2007 | Beamer et al. |
| 2009/0065185 | A1 | 3/2009 | Jekerle |
| 2010/0218927 | A1 | 9/2010 | Cooper et al. |
| 2010/0258284 | A1 | 10/2010 | Krantz |
| 2010/0282437 | A1 | 11/2010 | Birmingham et al. |
| 2011/0042035 | A1 | 2/2011 | Seeblad |
| 2012/0305217 | A1 | 12/2012 | Cowburn et al. |
| 2013/0327513 | A1 | 12/2013 | Franz et al. |
| 2014/0054003 | A1 | 2/2014 | O'Boyle et al. |
| 2014/0090822 | A1 | 4/2014 | Seeblad |
| 2015/0144293 | A1 | 5/2015 | Seeblad |

FOREIGN PATENT DOCUMENTS

| | | | |
|---|---|---|---|
| CN | 101210780 | A | 7/2008 |
| EP | 0150913 | A2 | 8/1985 |
| EP | 0805331 | A2 | 11/1997 |
| EP | 0945195 | A2 | 9/1999 |
| EP | 1154143 | A1 | 11/2001 |
| EP | 1884732 | A2 | 2/2008 |
| EP | 2700893 | A1 | 2/2014 |
| EP | 2427712 | B1 | 4/2014 |
| FR | 775271 | A | 12/1934 |
| FR | 1219505 | A | 5/1960 |
| GB | 177780 | | 2/1923 |
| GB | 992413 | | 5/1965 |
| GB | 1339542 | | 12/1973 |
| GB | 1567239 | | 5/1980 |
| JP | 83112 | | 9/1929 |
| JP | 26-6787 | | 10/1951 |
| JP | S52746 | A | 1/1977 |
| JP | S5485547 | U | 6/1979 |
| JP | S5675590 | U | 6/1981 |
| JP | s57-154874 | U | 9/1982 |
| JP | S57154874 | U | 9/1982 |
| JP | 93590 | | 6/1987 |
| JP | 158996 | | 7/1987 |
| JP | 01-273996 | A | 11/1989 |
| JP | H08101000 | A | 4/1996 |
| JP | H09280764 | A | 10/1997 |
| JP | 10-328861 | A | 12/1998 |
| JP | H11294986 | A | 10/1999 |
| JP | 2001-516866 | A | 10/2001 |
| JP | 2003-200223 | A | 7/2003 |
| JP | 2004093036 | A | 3/2004 |
| KR | 100417321 | B1 | 2/2004 |
| KR | 10-2008-0063271 | | 7/2008 |
| WO | 98/14742 | A1 | 4/1998 |
| WO | 98/22768 | A1 | 5/1998 |
| WO | 99014543 | | 3/1999 |
| WO | 00/49357 | A1 | 8/2000 |
| WO | 2007012874 | A1 | 2/2007 |
| WO | 2010129092 | A1 | 11/2010 |
| WO | 2012000767 | A2 | 1/2012 |

OTHER PUBLICATIONS

International Search Report for corresponding PCT/US2016/056209 dated May 22, 2017.

HEAT TRANSFER SHEET FOR ROTARY REGENERATIVE HEAT EXCHANGER

CROSS REFERENCE TO RELATED APPLICATIONS

This application is a continuation application of U.S. patent application Ser. No. 14/926,920 filed Oct. 29, 2015, which is a continuation of U.S. patent application Ser. No. 12/437,914 filed May 8, 2009, and now issued as U.S. Pat. No. 9,557,119, the subject matter of both aforementioned patent applications is incorporated by reference herein in their entireties.

TECHNICAL FIELD

The devices described herein relate to heat transfer sheets of the type found in rotary regenerative heat exchangers.

BACKGROUND

Rotary regenerative heat exchangers are commonly used to recover heat from flue gases exiting a furnace, steam generator or flue gas treatment equipment. Conventional rotary regenerative heat exchangers have a rotor mounted in a housing that defines a flue gas inlet duct and a flue gas outlet duct for the flow of heated flue gases through the heat exchanger. The housing further defines another set of inlet ducts and outlet ducts for the flow of gas streams that receive the recovered heat energy. The rotor has radial partitions or diaphragms defining compartments therebetween for supporting baskets or frames to hold heat transfer sheets.

The heat transfer sheets are stacked in the baskets or frames. Typically, a plurality of sheets are stacked in each basket or frame. The sheets are closely stacked in spaced relationship within the basket or frame to define passageways between the sheets for the flow of gases. Examples of heat transfer element sheets are provided U.S. Pat. Nos. 2,596,642; 2,940,736; 4,363,222; 4,396,058; 4,744,410; 4,553,458; 6,019,160; and 5,836,379.

Hot gas is directed through the heat exchanger to transfer heat to the sheets. As the rotor rotates, the recovery gas stream (air side flow) is directed over the heated sheets, thereby causing the recovery gas to be heated. In many instances, the recovery gas stream consists of combustion air that is heated and supplied to a furnace or steam generator. Hereinafter, the recovery gas stream shall be referred to as combustion air or air. In other forms of rotary regenerative heat exchangers, the sheets are stationary and the flue gas and the recovery gas ducts are rotated.

SUMMARY OF THE INVENTION

In one aspect, a heat transfer sheet having utility in rotary regenerative heat exchangers is described. Gas flow is accommodated across the heat transfer sheet from a leading edge to a trailing edge. The heat transfer sheet is defined in part by a plurality of sheet spacing features such as ribs (also known as "notches") or flat regions extending substantially parallel to the direction of the flow of a heat transfer fluid such as air or flue gas. The sheet spacing features form spacers between adjacent heat transfer sheets. The heat transfer sheet also includes undulating surfaces extending between adjacent sheet spacing features, with each undulating surface being defined by lobes (also known as "undulations" or "corrugations"). The lobes of the different undulating surfaces extend at an angle $A_u$ relative to the sheet spacing features, the angle $A_u$ being different for at least a portion of the undulating surfaces, thereby providing different surface geometries on the same heat transfer sheet. The angle $A_u$ may also change for each of the lobes to provide a continuously varying surface geometry.

BRIEF DESCRIPTION OF THE DRAWINGS

The subject matter described in the description of the preferred embodiments is particularly pointed out and distinctly claimed in the claims at the conclusion of the specification. The foregoing and other features and advantages are apparent from the following detailed description taken in conjunction with the accompanying drawings in which:

DESCRIPTION OF THE PREFERRED EMBODIMENTS

Figure 1:
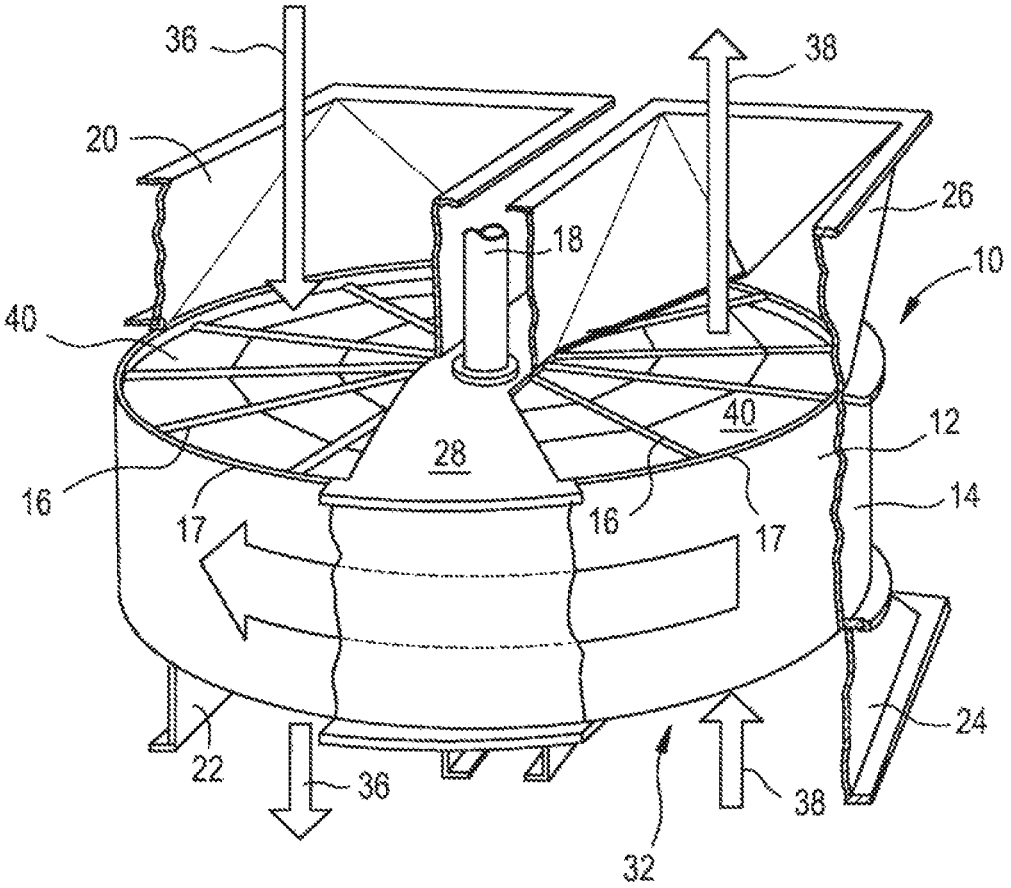
FIG. 1 PRIOR ART
FIG. 1 is a partially cut-away perspective view of a prior art rotary regenerative heat exchanger.

Referring to FIG. 1, a rotary regenerative heat exchanger, generally designated by the reference number 10, has a rotor 12 mounted in a housing 14. The housing 14 defines a flue gas inlet duct 20 and a flue gas outlet duct 22 for accommodating the flow of a heated flue gas stream 36 through the heat exchanger 10. The housing 14 further defines an air inlet duct 24 and an air outlet duct 26 to accommodate the flow of combustion air 38 through the heat exchanger 10. The rotor 12 has radial partitions 16 or diaphragms defining compartments 17 therebetween for supporting baskets (frames) 40 of heat transfer sheets (also known as "heat transfer elements"). The heat exchanger 10 is divided into an air sector and a flue gas sector by sector plates 28, which extend across the housing 14 adjacent the upper and lower faces of the rotor 12. While FIG. 1 depicts a single air stream 38, multiple air streams may be accommodated, such as tri-sector and quad-sector configurations. These provide multiple preheated air streams that may be directed for different uses.

Figure 2:
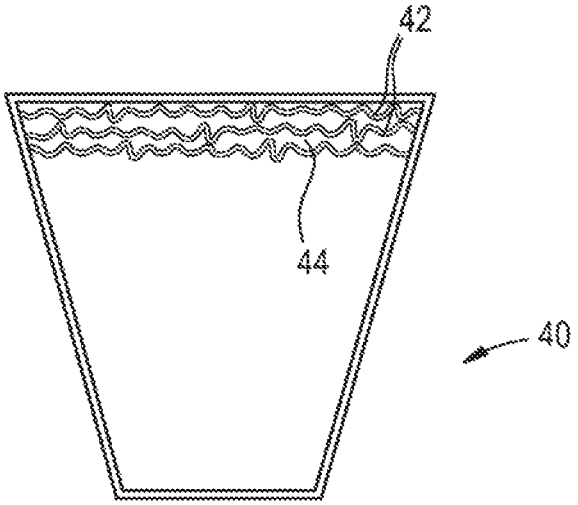
FIG. 2 PRIOR ART
FIG. 2 is a top plan view of a basket including three prior art heat transfer sheets.

As is shown in FIG. 2, one example of a sheet basket 40 (hereinafter "basket 40" includes a frame 41 into which heat transfer sheets 42 are stacked. While only a limited number of heat transfer sheets 42 are shown, it will be appreciated that the basket 40 will typically be filled with heat transfer sheets 42. As also seen in FIG. 2, the heat transfer sheets 42 are closely stacked in spaced relationship within the basket 40 to form passageways 44 between adjacent heat transfer sheets 42. During operation, air or flue gas flows through the passageways 44.

Referring to both FIGS. 1 and 2, the heated flue gas stream 36 is directed through the gas sector of the heat exchanger 10 and transfers heat to the heat transfer sheets 42. The heat transfer sheets 42 are then rotated about axis 18 to the air sector of the heat exchanger 10, where the combustion air 38 is directed over the heat transfer sheets 42 and is thereby heated.

Figure 3:
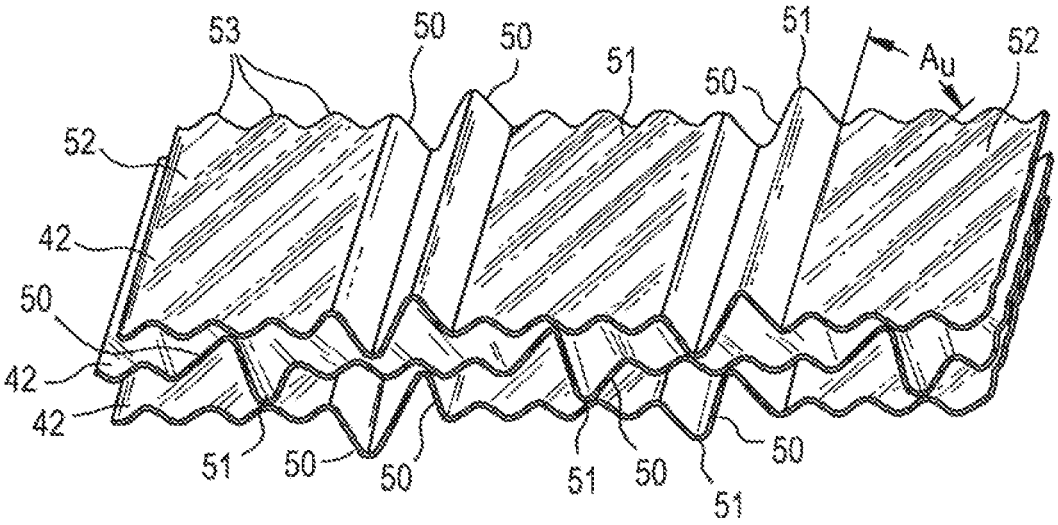
FIG. 3 PRIOR ART
FIG. 3 is a perspective view of a portion of three prior art heat transfer sheets shown in a stacked configuration.
Figure 4:
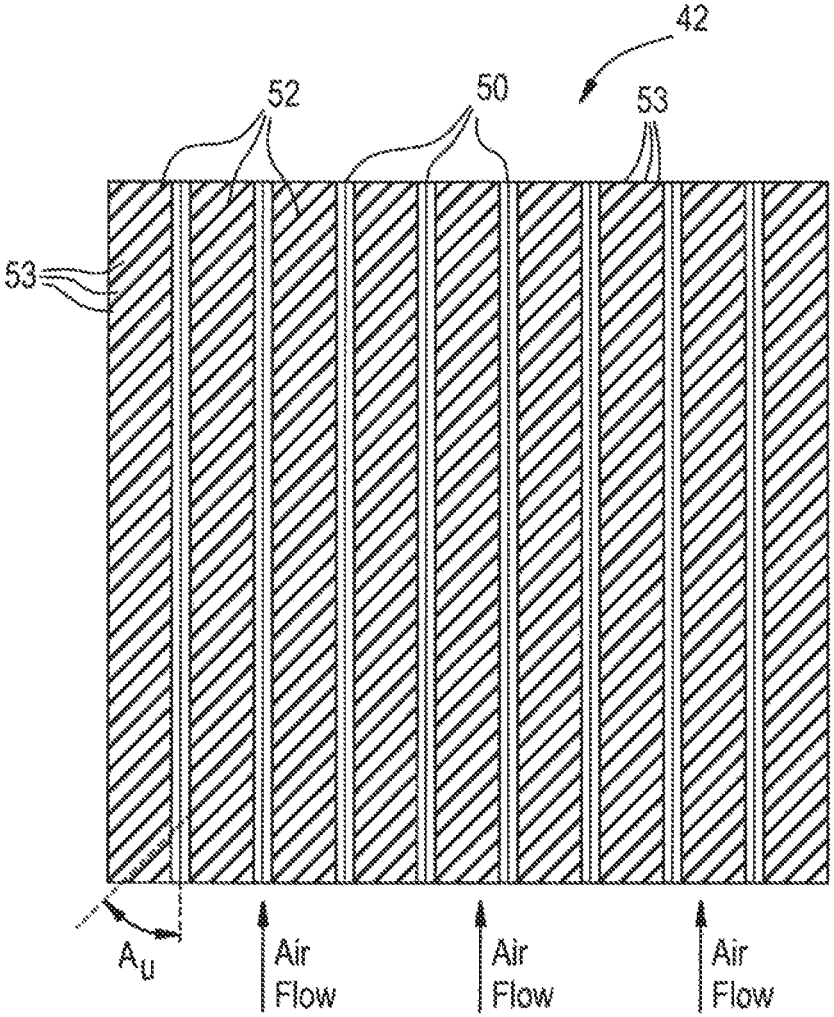
FIG. 4 PRIOR ART
FIG. 4 is a side elevational view of a prior art heat transfer sheet.

Referring to FIGS. 3 and 4, conventional heat transfer sheets 42 are shown in a stacked relationship. Typically, heat transfer sheets 42 are steel planar members that have been shaped to include one or more ribs 50 (also known as "notches") and undulating surfaces 52 defined in part by undulation peaks 53. The undulation peaks 53 extend upward and downward in an alternating fashion (also known as "corrugations").

The heat transfer sheets 42 also include a plurality of larger ribs 50 each having rib peaks 51 that are positioned at generally equally spaced intervals and operate to maintain spacing between adjacent heat transfer sheets 42 when stacked adjacent to one another and cooperate to form sides of passageways (44 of FIG. 2). These accommodate the flow of air or flue gas between the heat transfer sheets 42. The undulation peaks 53 defining the undulating surfaces 52 in the prior art heat transfer sheet 42 are of all the same height. As shown in FIG. 4, the ribs 50 extend at a predetermined angle (e.g. 0 degrees) relative to the flow of air or flue gas through the rotor (12 of FIG. 1).

The undulation peaks 53 defining the undulating surfaces 52 in the prior art are arranged at the same angle $A_u$ relative to the ribs and, thus, the same angle relative to the flow of air or flue gas indicated by the arrows marked "Air Flow". The undulating surfaces 52 act, among other things, to increase turbulence in the air or flue gas flowing through the passageways (44 of FIG. 2) and thereby disrupt the thermal boundary layer at the surface of the heat transfer sheet 42. In this manner, the undulating surfaces 52 improve heat transfer between the heat transfer sheet 42 and the air or flue gas.

Figure 5:
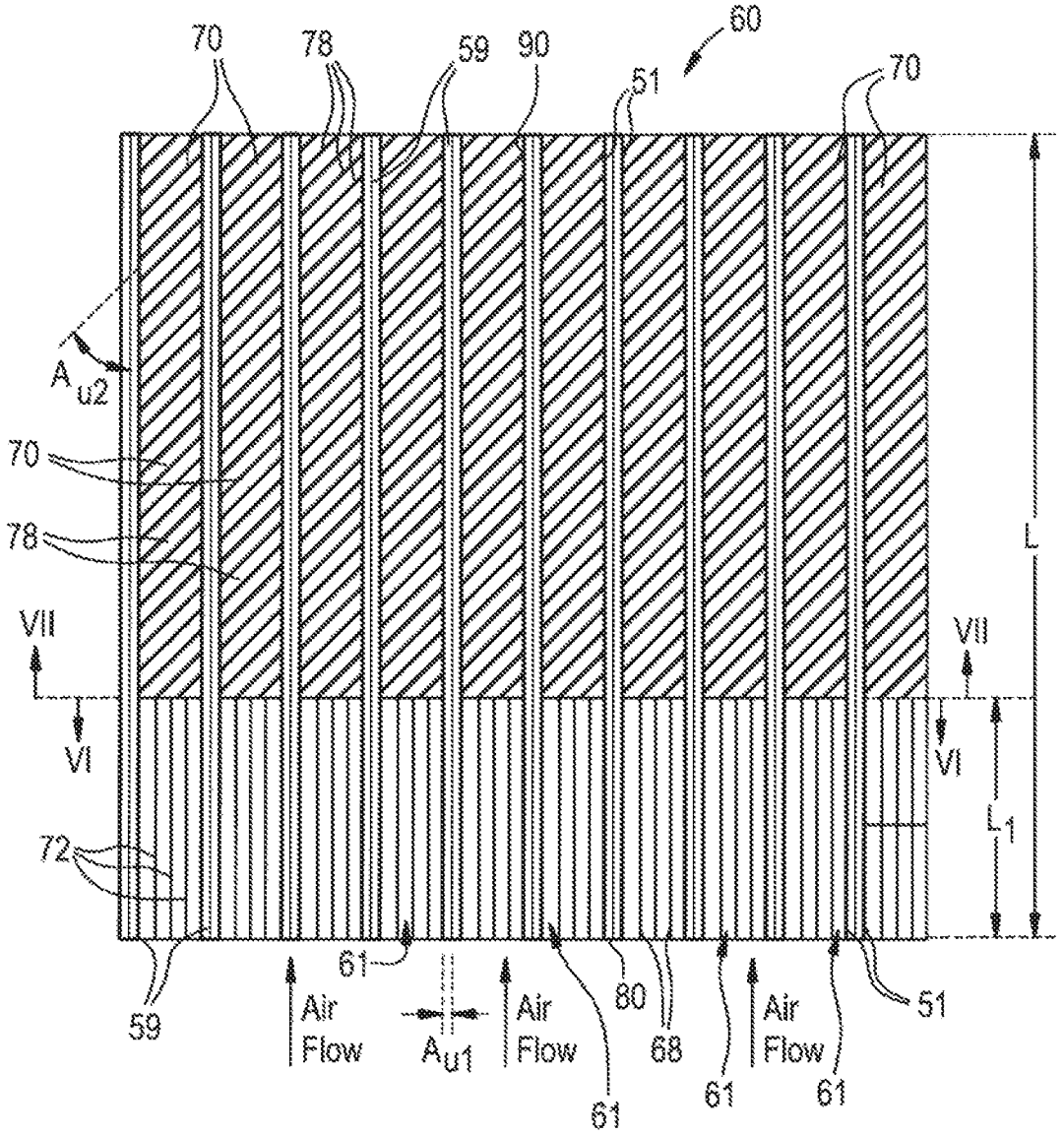
FIG. 5 is a side elevational view of a heat transfer sheet according to one embodiment of the present invention having two different surface geometries on the same sheet.
Figure 6:
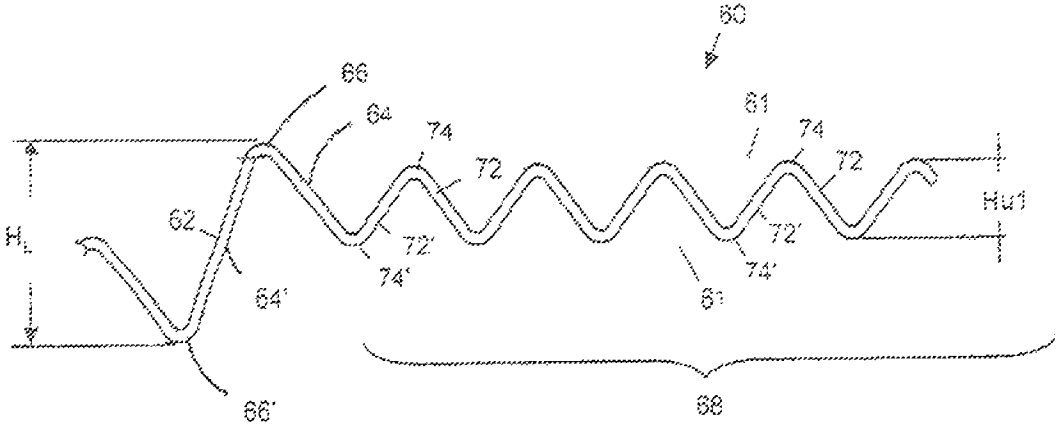
FIG. 6 is a cross-sectional elevation view of a portion of the heat transfer sheet, as taken at section VI-VI of FIG. 5.
Figure 7:
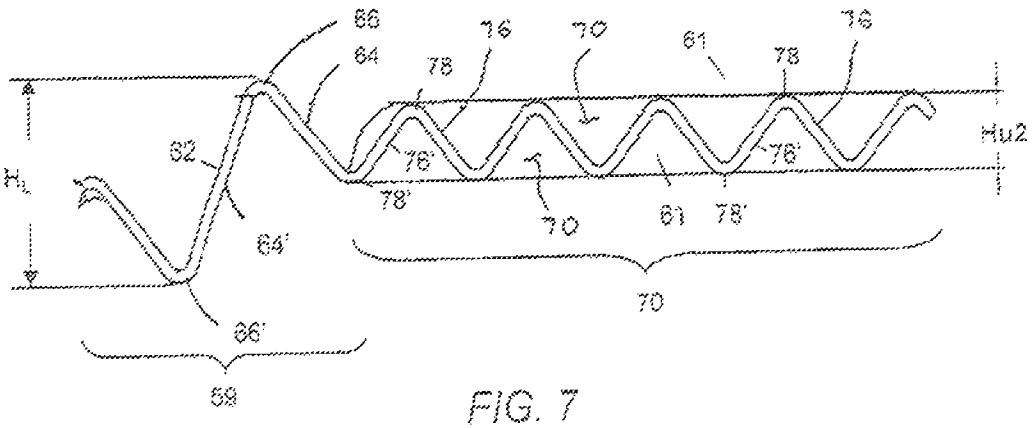
FIG. 7 is a cross-sectional elevation view of a portion of the heat transfer sheet, as taken at section VII-VII of FIG. 5.

As shown in FIGS. 5-7, a novel heat transfer sheet 60 has a length L substantially parallel to a direction of heat transfer fluid (hereinafter "air or flue gas") flow and extending from a leading edge 80 to a trailing edge 90. The terms "leading edge" and "trailing edge" are used herein for convenience. They relate to the flow of hot air across the sheet 60 indicated by the arrows and labeled "Air Flow".

The heat transfer sheet 60 may be used in place of conventional heat transfer sheets 42 in a rotary regenerative heat exchanger. For example, heat transfer sheets 60 may be stacked and inserted in a basket 40 for use in a rotary regenerative heat exchanger.

The heat transfer sheet 60 includes sheet spacing features 59 formed thereon, which effect the desired spacing between sheets 60 and form flow passages 61 between the adjacent heat transfer sheets 60 when the sheets 60 are stacked in the basket 40 (FIG. 2). The sheet spacing features 59 extend in spaced relationship substantially along the length of the heat transfer sheet (L of FIG. 5) and substantially parallel to the direction of the flow of air or flue gas through the rotor of the heat exchanger. Each flow passage 61 extends along the entire length L of the sheet 60, from the leading edge 80 to the trailing edge 90, between adjacent ribs 62.

In the embodiment shown in FIGS. 6 and 7, the sheet spacing features 59 are shown as ribs 62. Each rib 62 is defined by a first lobe 64 and a second lobe 64'. The first lobe 64 defines a peak (apex) 66 that is directed outwardly from a peak 66' defined by the second lobe 64' in a generally opposite direction. An overall height of one rib 62 between the peaks 66 and 66', respectively, is HL. The peaks 66, 66' of the ribs 62 engage the adjacent heat transfer sheets 60 to maintain the spacing between adjacent heat transfer sheets. The heat transfer sheets 60 may be arranged such that the ribs 62 on one heat transfer sheet are located about mid-way between the ribs 62 on the adjacent heat transfer sheets for support. As shown in FIG. 5, the flow passages 61 define a straight portion that extends the entire length L between a first end and a second end. The straight portion is positioned over the undulating surfaces 68.

This is a significant advancement in the industry, because it was previously not known how to create two different types of undulations on a single sheet. The present invention does so without the need for joints or welds between undulation sections.

It is also contemplated that the sheet spacing features 59 may be of other shapes to effect the desired spacing between sheets 60 and form flow passages 61 between the adjacent heat transfer sheets 60.

Figure 11:
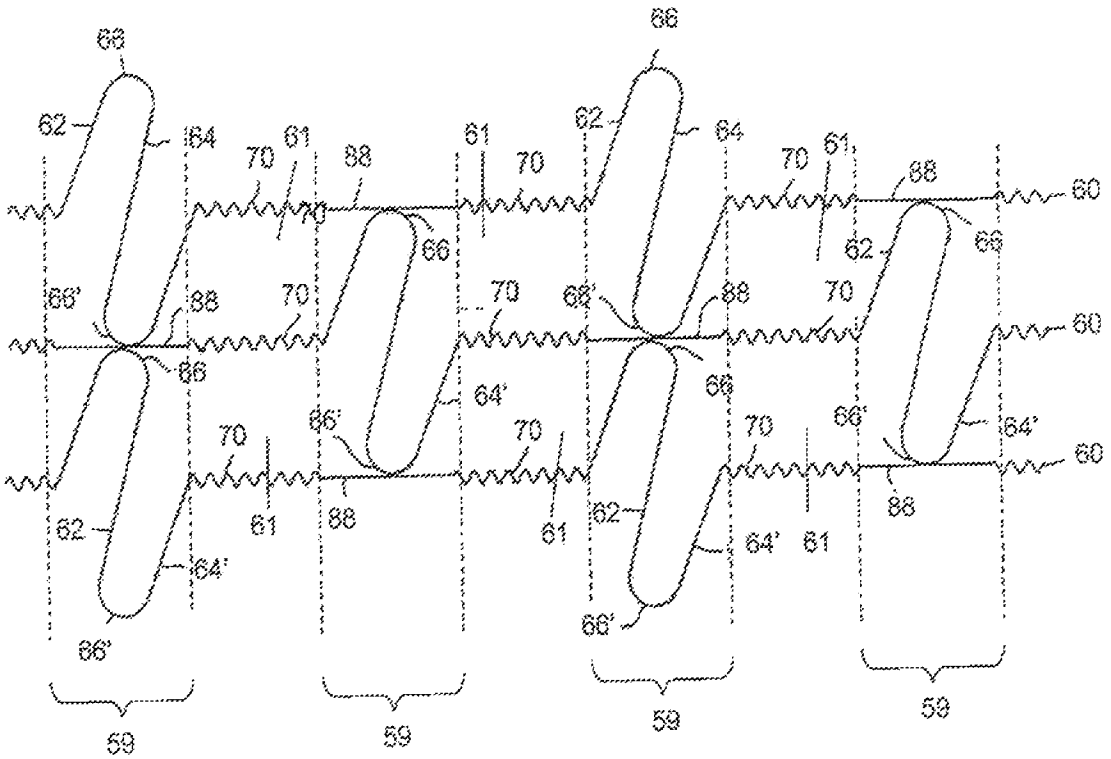
FIG. 11 is a cross-sectional elevation view of a portion of another embodiment of three heat transfer sheets according to the present invention in stacked relationship.
Figure 12:
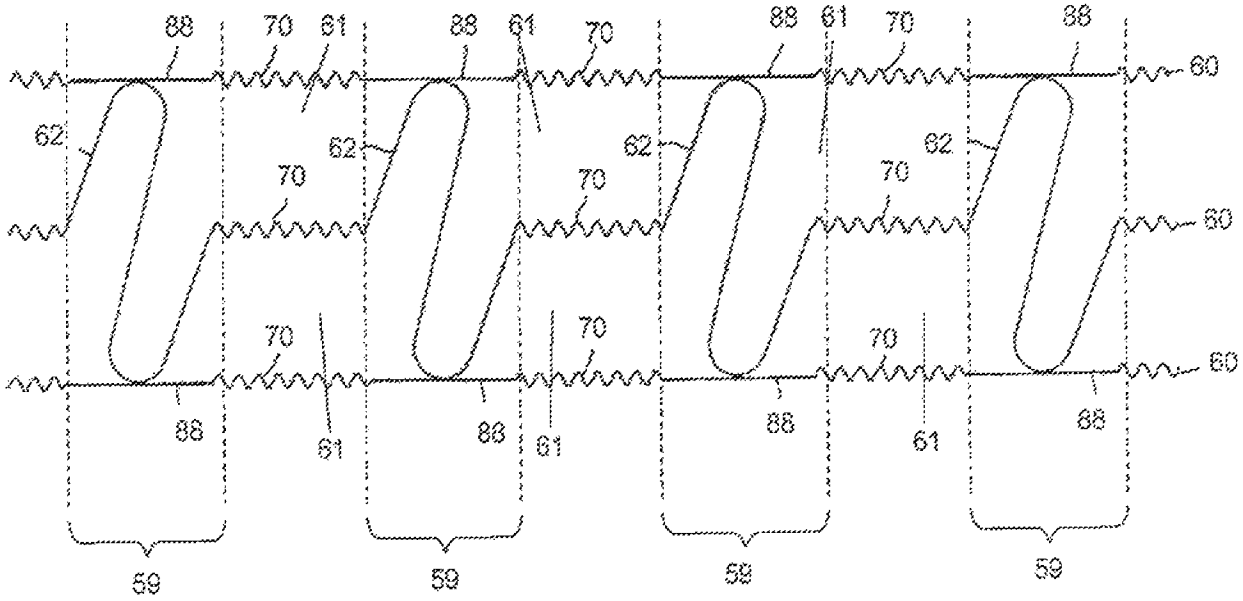
FIG. 12 is a cross-sectional elevation view of a portion of another embodiment of three heat transfer sheets in stacked relationship.

As is shown in FIGS. 11 and 12, the heat transfer sheet 60 may include sheet spacing features 59 in the form of longitudinally extending flat regions 88 that are substantially parallel to, and spaced equally with, ribs 62 of an adjacent heat transfer sheet, upon which the ribs 62 of the adjacent heat transfer sheet rest. Like the ribs 62, the flat regions 88 extend substantially along the entire length L of the heat transfer sheet 60. For example, as shown in FIG. 11, the sheet 60 may include alternating ribs 62 and flat regions 88, which rest on the alternating ribs 62 and flat regions 88 of an adjacent sheet 60. Alternatively, as shown in FIG. 12, one heat transfer sheet 60 may include all longitudinally extending flat regions 88, with the other heat transfer sheet 60 includes all ribs 62.

Still referring to FIGS. 5-7, disposed on the heat transfer sheet 60 between the sheet spacing features 59 are several undulating surfaces 68 and 70. Each undulating surface 68 extends substantially parallel to the other undulating surfaces 68 between the sheet spacing features 59.

As is shown in FIG. 6, each undulating surface 68 is defined by lobes (undulations or corrugations) 72, 72'. Each lobe 72, 72' defines in part a U-shaped channel having respective peaks 74, 74', and each lobe 72, 72' extends along the heat transfer sheet 60 in a direction defined along the ridges of its peaks 74, 74' as shown in FIG. 5. Each of the undulating surfaces 68 has a peak-to-peak height $H_{u1}$. The undulating surfaces 68 are in the flow passage 61.

Referring now to FIGS. 5 and 7, each undulating surface 70 extends substantially parallel to the other undulating surfaces 70 between the sheet spacing features 59. Each undulating surface 70 includes one lobe (undulation or corrugation) 76 projecting in an opposite direction from another lobe (undulation or corrugation) 76'. Each lobe 76, 76' defines in part a channel 61 having respective peaks 78, 78', and each lobe 76, 76' extends along the heat transfer sheet 60 in a direction defined along the ridges of its peaks 74, 74' as shown in FIG. 6. Each of the undulating surfaces 70 has a peak-to-peak height of $H_{u2}$.

The lobes 72, 72' of undulating surfaces 68 extend at different angles than the lobes 76, 76' of undulating surfaces 70, with respect to the sheet spacing features 59, as indicated by angles $A_{u1}$ and $A_{u2}$, respectively.

The sheet spacing features 59 are generally parallel to the main flow direction of the air or flue gas across the heat transfer sheet 60. As is shown in FIG. 5, the channels of the undulating surfaces 68 extend substantially parallel to the direction of the sheet spacing features 59, and the channels of the undulating surfaces 70 are angled in the same direction as undulation peaks 78. As is shown, if $A_{u1}$ is zero degrees, then $A_{u2}$ in this embodiment is approximately 45 degrees. In contrast, as shown in FIG. 4, the undulating surfaces 52 in conventional heat transfer sheets 42 all extend at the same angle, $A_u$, relative to the adjacent sheet spacing features 59.

The angles described here are only for illustrative purposes. It is to be understood that the invention encompasses a wide variety of angles.

The length L1 of the undulating surfaces 68 of FIG. 5 (and FIG. 8) may be selected based on factors such as heat transfer fluid flow, desired heat transfer, location of the zone where sulfuric acid, condensable compounds, and particulate matter collect on the heat transfer surface, and desired sootblower penetration for cleaning. Soot blowers have been used to clean heat transfer sheets. These deliver a blast of high-pressure air or steam through the passages (44 of FIG. 2, 61 of FIGS. 6, 7, 11, 12) between the stacked elements to dislodge particulate deposits from the surface of heat transfer sheets. To aid in the removal of deposits that will form on the heat transfer surface during operation, it may be desirable to select L1 to be a distance such that all or a portion of the deposit is located on the section of the heat transfer sheet that is substantially parallel to the direction of the flow of air or flue gas through the rotor of the heat exchanger (36, 38 of FIG. 1). Preferably, however, L1 may be less than one-third of the entire length L of the heat transfer sheet 60, and more preferably less than one-fourth of the entire length L of the heat transfer sheet 60. This provides a sufficient amount of undulating surface 70 to develop turbulent flow of the heat transfer fluid and so that the turbulent flow continues across the undulating surface 70. Undulating surface 70 is constructed to be sufficiently rigid to withstand the full range of operating conditions, including cleaning with a sootblower jet, for the heat transfer sheet 60.

The lengths described here are only for illustrative purposes. It is to be understood that the invention encompasses a wide variety of lengths and length ratios.

In general, the higher the sulfur content in the fuel, the longer L1 (and Li, L3) should be for optimum performance. Also, the lower the gas outlet temperature from the air preheater, the longer L1 (and L2, L3) should be for optimum performance.

Figure 14:
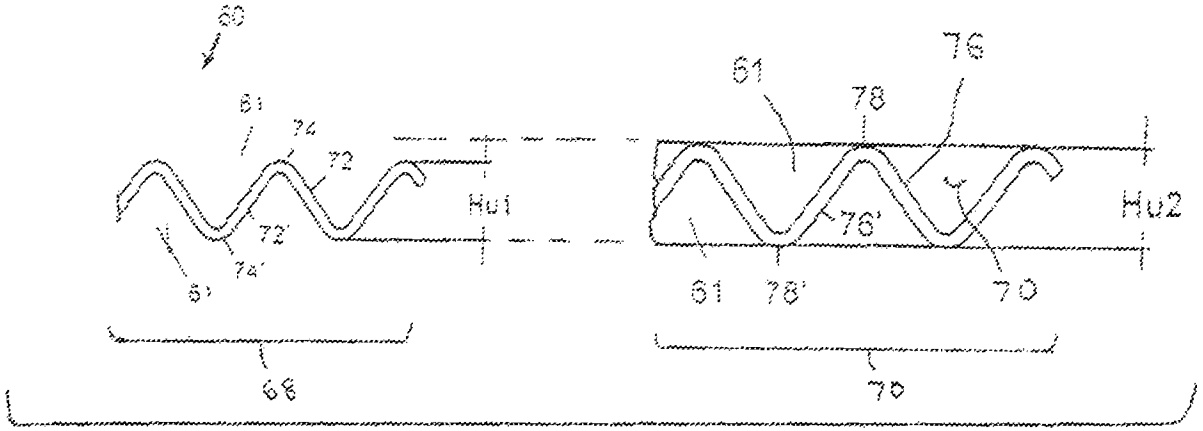
FIG. 14 illustrates portions of the heat transfer sheets of FIGS. 6 and 7 in a side by side format.

Referring again to FIGS. 6 and 7, it is contemplated that $H_{u1}$ and $H_{u2}$ may be equal. Alternatively, $H_{u1}$ and $H_{u2}$ may differ. For example, $H_{u1}$ is less than $H_{u2}$ (see FIG. 14), and both $H_{u1}$ and $H_{u2}$ are less than $H_L$. In contrast, as shown in FIG. 4, the undulating surfaces 52 in conventional heat transfer sheets 42 are all of the same height.

CFD modeling by the inventors has shown that the embodiment of FIG. 5 allows for maintaining higher velocity and kinetic energy of the sootblower jet to a deeper location within flow passage (61 of FIGS. 6 and 7), which is expected to lead to better cleaning.

The embodiment of FIG. 5 is believed to allow for better cleaning by a soot blower jet, or potentially cleaning a stickier deposit on the heat transfer surface since the undulating surfaces 68 are better aligned with a jet directed towards the leading edge 80, thus allowing for greater penetration of the soot blower jet along the flow passages (61 of FIGS. 6, 7).

Furthermore, when the configuration of the undulating surface 68 provides a better line-of sight between the heat transfer sheets 60, the heat transfer sheet as described herein becomes more compatible with an infrared radiation (hot spot) detector.

The embodiment of FIG. 5 proved to have low susceptibility to flutter during soot blowing tests. In general, fluttering of the heat transfer sheets is undesirable as it causes excessive deformation of the sheets, plus it causes them to wear against each other and, thereby, reduce the useful life of the sheets. Since the undulating surfaces 68 are substantially aligned with the direction of the soot blower jet (Air Flow), the velocity and kinetic energy of the sootblower jet is preserved to a greater depth along the flow channel (61 of FIGS. 6 and 7). This results in more energy being available for removal of the deposit on the heat transfer surface.

Figure 8:
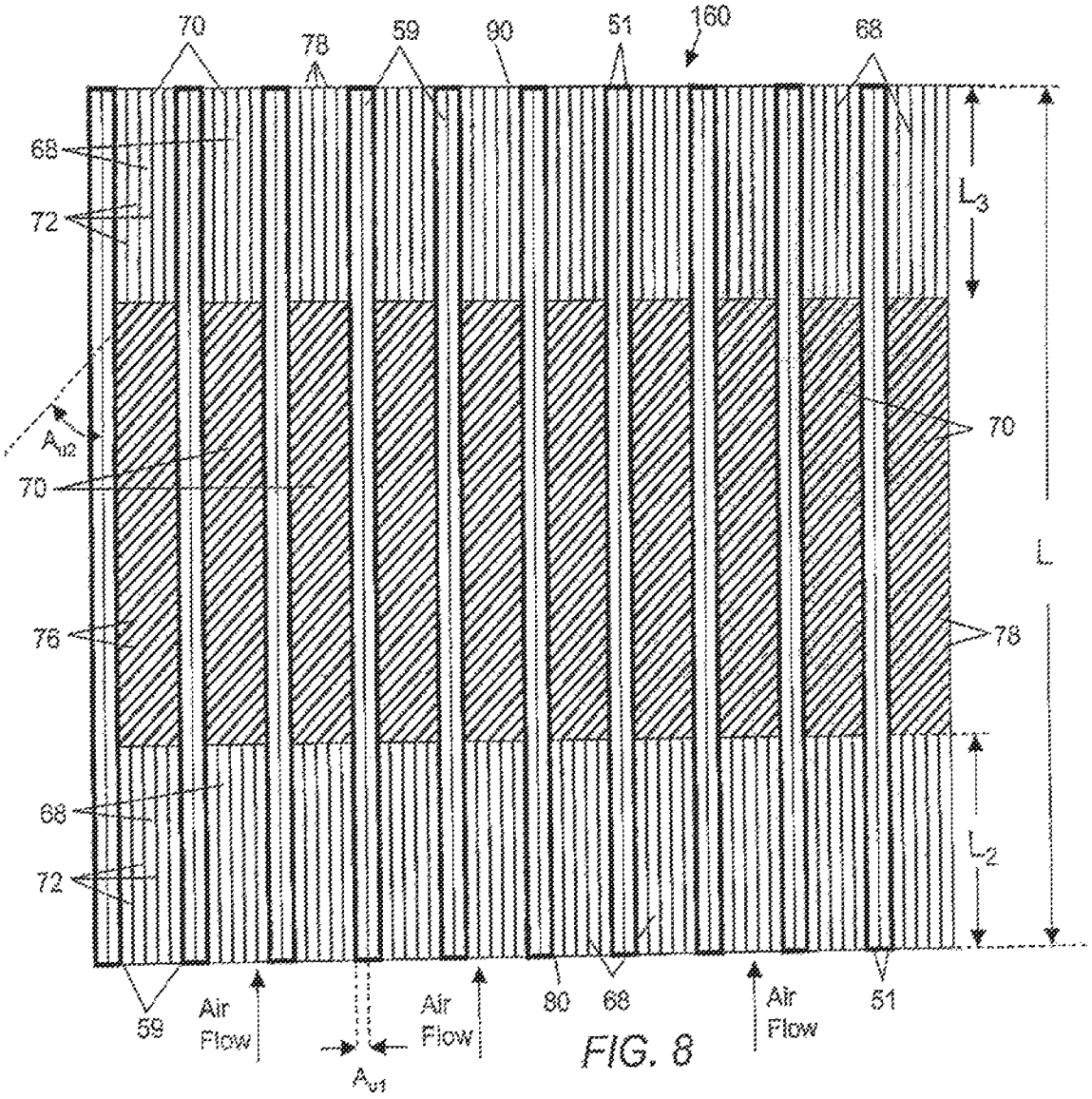
FIG. 8 is a side elevational view of an embodiment of a heat transfer sheet showing another arrangement of two different surface geometries on the same sheet.

FIG. 8 shows another embodiment of a heat transfer sheet 160 that incorporates three surface geometries. In a mam ler similar to heat transfer sheet 60, heat transfer sheet 160 has a series of sheet spacing features 59 at spaced intervals that extend longitudinally and substantially parallel to the direction of the flow of the air or flue gas through the rotor of a heat exchanger.

Heat transfer sheet 160 also includes undulating surfaces 68 and 70, with undulating surfaces 68 being located on both a leading edge 80 and a trailing edge 90 of the heat transfer sheet 160. As is shown in FIGS. 6-8, the lobes 72 of undulating surfaces 68 extend in the first direction represented by angle $A_{u1}$ relative to the sheet spacing features 59. Here $A_{u1}$ is zero since sheet spacing features 59 is parallel to lobes 72. Lobes 76 of undulating surfaces 70 extend in the second direction $A_{u2}$ relative to the sheet spacing features 59.

The present invention is not limited in this regard, however, as the undulating surfaces 68 at the trailing edge 90 of the sheet 60 may be angled differently from the undulating surfaces 68 at the leading edge 80. The heights of the undulating surfaces 68 may also be varied relative to the heights of the undulating surfaces 70. For example, a sum of the length L3 of the undulating surfaces 68 at the trailing edge 90 and the length L2 of the undulating surfaces 68 at the leading edge 80 is less than one-half of the length L of the heat transfer sheet 60. Preferably, it is less than one-third of the entire L of the heat transfer sheet 60. The heat transfer sheet 160 of FIG. 8 may be used, for example, where soot blowers are directed at both the leading and trailing edges 80 and 90.

Figure 9:
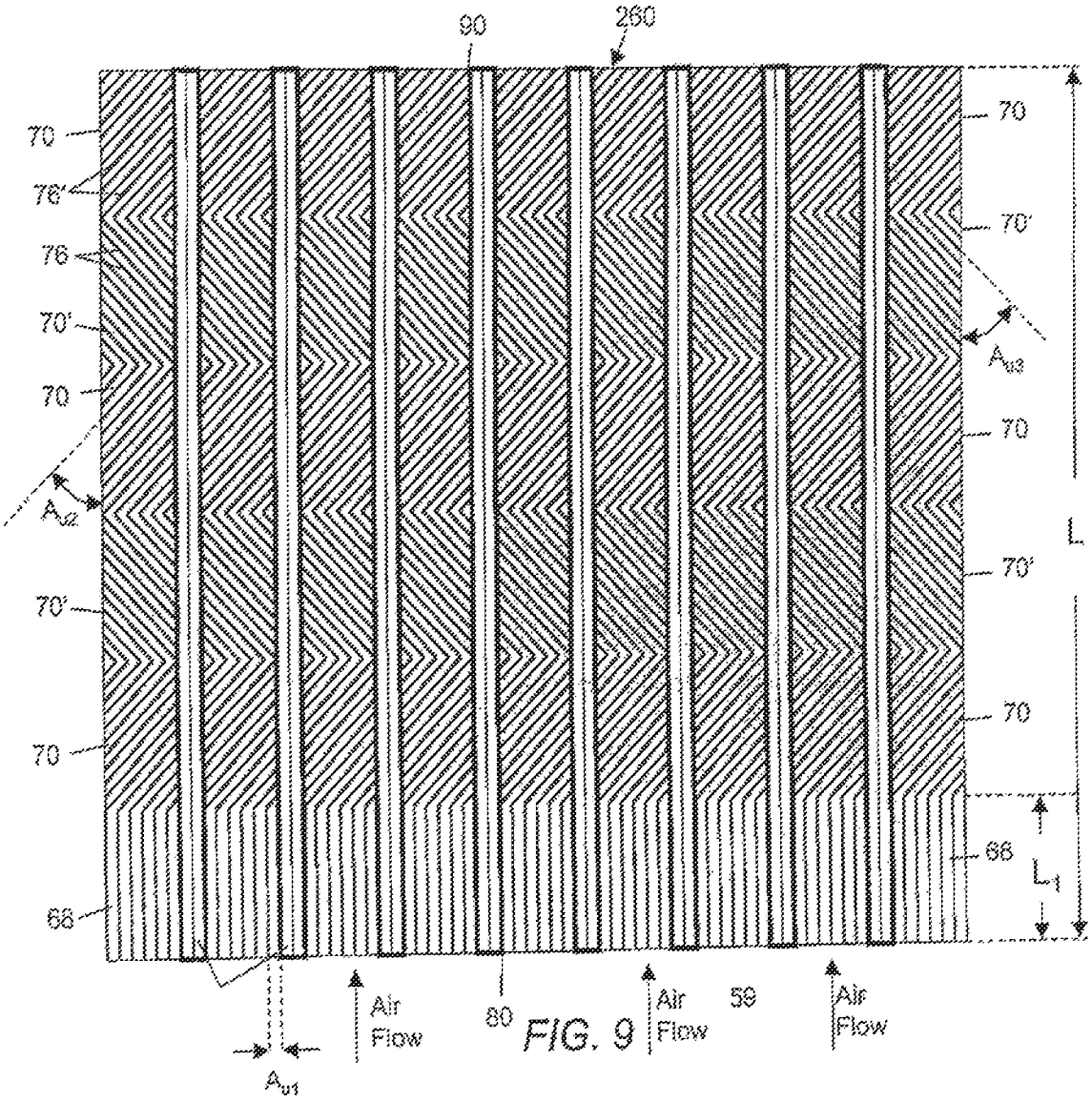
FIG. 9 is a side elevational view of another heat transfer sheet showing three or more different surface geometries on the same sheet.

The heat transfer sheet of the present invention may include any number of different surface geometries along the length of each flow passage 61. For example, FIG. 9 depicts a heat transfer sheet 260 that incorporates three different surface geometries. In a manner similar to heat transfer sheets 60 and 160, heat transfer sheet 260 includes sheet spacing features 59 at spaced intervals which extend longitudinally and parallel to the direction of the flow of air or flue gas through the rotor of a heat exchanger and defining flow passages 61 between adjacent sheets 260.

Heat transfer sheet 260 also includes undulating surfaces 68, 70 and 71 with undulating surfaces 68 being located on a leading edge 80. As is shown, the lobes 72 of undulating surfaces 68 extend in a first direction represented by angle $A_{u1}$ (parallel to the sheet spacing features 59, as is shown, for example). The lobes 76 of undulating surfaces 70 extend across the heat transfer sheet 260 in a second direction at angle $A_{u2}$ relative to the sheet spacing features 59, and the lobes 73 of undulating surfaces 71 extend across the heat transfer sheet 260 in a third direction at angle $A_{u3}$ relative to the sheet spacing features 59, which is different from $A_{u2}$ and $A_{u1}$. For example, $A_{u3}$ maybe the negative (reflected) angle of $A_{u2}$ relative to the sheet spacing features 59. As with other embodiments disclosed herein, the heights $H_{u1}$ and $H_{u2}$ of undulating surfaces 68, 70, and 71 may be varied.

As is shown, undulating surfaces 70 and 71 alternate along the heat transfer sheet 260, thereby providing for increased turbulence of the heat transfer fluid as it flows. The turbulence comes in contact with the heat transfer sheets 260 for a longer period of time and thus enhances heat transfer. The swirl flow also serves to mix the flowing fluid and provides a more uniform flow temperature.

This turbulence is believed to enhance the heat transfer rate of the heat transfer sheets 60 with a minimal increase in pressure drop, while causing a significant increase in the amount of total heat transferred.

Figure 10:
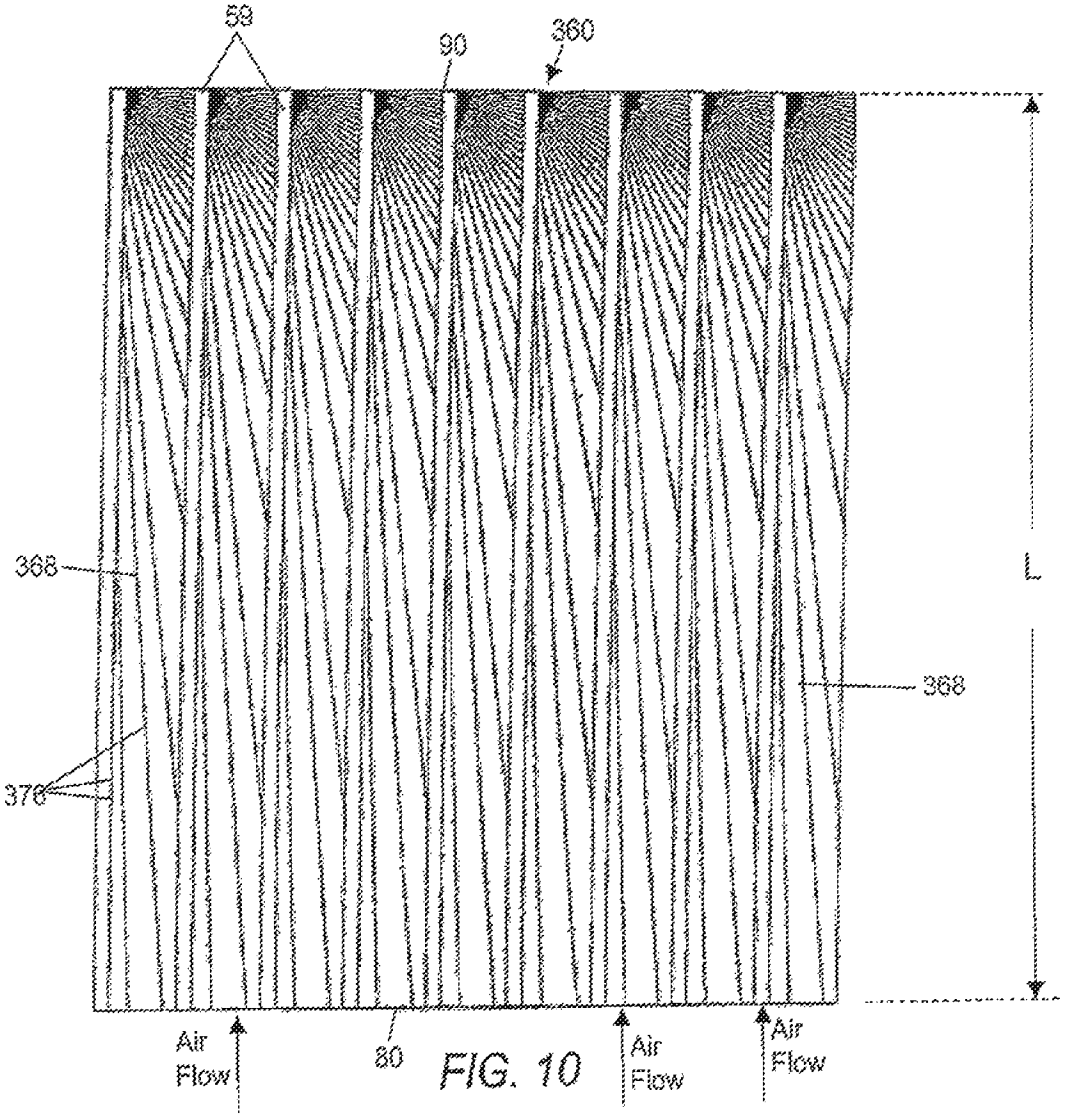
FIG. 10 is a side elevational view of yet another embodiment of a heat transfer sheet showing a surface geometry that varies continuously over the length of the sheet.

Referring to FIG. 10, a heat transfer sheet 360 incorporates a continuously varying surface geometry along a plurality of lobes 376. In a manner similar to heat transfer sheets 60, 160, and 260, heat transfer sheet 360 includes sheet spacing features 59 at spaced intervals which extend longitudinally and substantially parallel to the direction of the flow of the air or flue gas through the rotor of a heat exchanger and defining flow passages such as flow passages 61 of FIGS. 6 and 7, between adjacent sheets 360.

Flow passages (similar to flow passages 61 of FIGS. 6, 7, 11 and 12) are created between the sheet spacing features 59 under lobes 376 of the undulating surface 368. The lobes 376 become increasingly angled with respect to the sheet spacing features 59 over the length L of the sheet 360 from the leading edge 80 to the trailing edge 90. This construction allows a soot blower jet to penetrate from the leading edge 80 a greater distance into the flow passages as compared with prior art designs.

This design also exhibits greater heat transfer and fluid turbulence near the trailing edge 90. The progressive angling of the undulating surfaces 368 avoids the need for a sharp transition to undulating surfaces of a different angle, while still permitting the undulating surfaces to be somewhat aligned with a soot blower jet to effect deeper jet penetration and better cleaning. The heights of the undulating surfaces 368 may also be varied along the length L of the heat transfer sheet 360.

FIG. 11 shows an alternative embodiment in which parts with the same numbers have the same function as those described in FIGS. 6 and 7. In this embodiment, flat portions 88 meet up with peaks 66 and 66' creating a more effective seal between flow passages 61 on the left and right sides of each sheet spacing feature. Flow passages are referred to as a 'closed channel'.

FIG. 12 shows another alternative embodiment of the present invention in which parts with the same numbers have the same function as those described in the previous figures. This embodiment differs from FIG. 11 in that sheet spacing features 59 are only included on the center heat transfer sheet.

Figure 13:
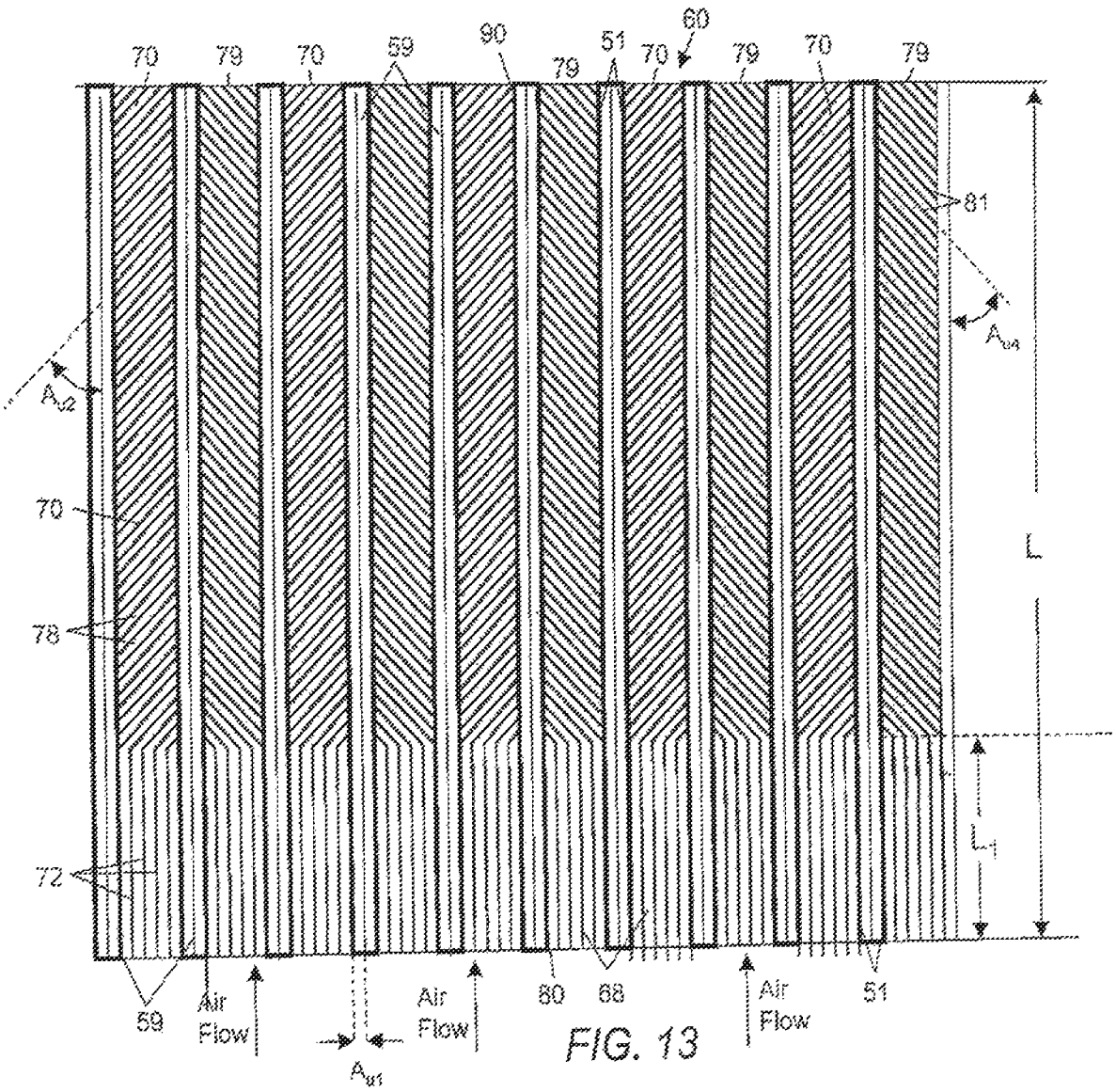
FIG. 13 is a side elevational view of a heat transfer sheet according to one embodiment of the present invention having two different surface geometries on the same sheet.

FIG. 13 is a top plan view of a heat transfer sheet showing another arrangement of two different surface geometries on the same sheet. Parts with the same reference numbers as that of the previous figures perform the same function. This embodiment is similar to that of FIG. 5. In this embodiment, adjacent undulation surfaces 70, 79 have peaks 78, 81 that are angled in opposite directions with respect to sheet spacing features 59. Undulation peaks 78 make an angle $A_{u2}$ with respect to sheet spacing features 59. Undulation peaks 81 make an angle $A_{u4}$ with respect to sheet spacing features 59.

FIG. 13 is used for purposes of illustration, however, it should be noted that the invention covers many other embodiments that have adjacent undulated sections parallel lobes each oriented with the angles of their lobes aligned opposite each other.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat transfer sheet comprising:

a first undulating surface extending along a length of the heat transfer sheet, the first undulating surface being formed by first lobes, the first lobes being parallel to each other and oriented at a first angle relative to a longitudinal direction of flow of hot flue gas; and a second undulating surface extending along the length of the heat transfer sheet, the second undulating surface being formed by second lobes, the second lobes being parallel to each other and oriented at a second angle relative to the longitudinal direction of flow of hot flue gas, the first angle and second angle being different, wherein the first undulating surface and the second undulating surface are laterally adjacent, lateral being generally perpendicular to the longitudinal direction, a third undulating surface formed by third lobes, the third undulating surface extending along a portion of the length of the heat transfer sheet, the portion extending from a first end of the heat transfer sheet and terminating at an intermediate point along the length of the heat transfer sheet between the first end and an opposing second end of the heat transfer sheet, the third lobes being parallel to each other and parallel to the longitudinal direction of flow of hot flue gas, wherein the third undulating surface transitions at a point of contact to the first undulating surface, and wherein the third undulating surface transitions at a point of contact to the second undulating surface.

2. A stacked configuration of rotary regenerative heat exchanger sheets, the stacked configuration comprising:

at least two first heat transfer sheets, wherein each of the at least two first transfer sheets include:

at least one first undulating surface extending along a length of the first heat transfer sheet, the first undulating surface being formed by first lobes, the first lobes being parallel to each other and oriented at a first angle relative to a longitudinal direction of flow of hot flue gas through the stacked configuration of rotary heat transfer elements; and at least one second undulating surface extending along a length of the first heat transfer sheet, the second undulating surface being formed by second lobes, the second lobes being parallel to each other and oriented at a second angle relative to the longitudinal direction of flow of hot flue gas through the stacked configuration of rotary heat transfer elements, the first angle and second angle being different, wherein each of the at least one first undulating surface is laterally spaced uniformly apart from each of the at least one second undulating surface such that the first undulating surface and the second undulating surface are separated from each other, lateral being generally perpendicular to the longitudinal direction;

wherein at least one of the at least two first heat transfer sheets further comprises:

a third undulating surface formed by third lobes, the third undulating surface extending along a portion of the length of the first heat transfer sheet, the portion extending from a first end of the first heat transfer sheet and terminating at an intermediate point along the length of the first heat transfer sheet between the first end and an opposing second end of the first heat transfer sheet, the third lobes being parallel to each other and parallel to the longitudinal direction of flow of hot flue gas through the stacked configuration of rotary heat transfer elements;

wherein the third undulating surface transitions at a point of contact to the first undulating surface; and wherein the third undulating surface transitions at a point of contact to the second undulating surface.

3. The stacked configuration according to claim 2, further comprising:

at least one second heat transfer sheet defining a plurality of sheet spacing features, at least one of the plurality of sheet spacing features engaging a portion of at least one of the first heat transfer sheets.

4. The stacked configuration according to claim 3, wherein at least one of the plurality of sheet spacing features engages at least one of the first undulating surface, the second undulating surface and the third undulating surface.

5. The stacked configuration of claim 3, wherein the sheet spacing features define a portion of a flow passage between the at least one second heat transfer sheet and an adjacent one of the at least one first heat transfer sheet, and the sheet spacing features extend along the second heat transfer sheet from a first end of the second heat transfer sheet to a second end opposite the first end and extend substantially parallel to the direction of flow of hot flue gas.

6. The stacked configuration of claim 4, wherein the at least one of the plurality of sheet spacing features engages the third undulating surface.

* * * * *